US008006736B2

(12) United States Patent
Hoffmann et al.

(10) Patent No.: US 8,006,736 B2
(45) Date of Patent: Aug. 30, 2011

(54) SKEW ADJUSTMENT DEVICE FOR COVERINGS FOR ARCHITECTURAL OPENINGS

(75) Inventors: Brian M. Hoffmann, Louisville, CO (US); Stephen P. Smith, Denver, CO (US); James L. Miller, Henderson, CO (US)

(73) Assignee: Hunter Douglas Inc., Upper Saddle River, NJ (US)

( * ) Notice: Subject to any disclaimer, the term of this patent is extended or adjusted under 35 U.S.C. 154(b) by 91 days.

(21) Appl. No.: 12/573,993

(22) Filed: Oct. 6, 2009

(65) Prior Publication Data

US 2010/0018657 A1 Jan. 28, 2010

Related U.S. Application Data

(62) Division of application No. 11/750,041, filed on May 17, 2007, now Pat. No. 7,617,858.

(60) Provisional application No. 60/747,957, filed on May 23, 2006.

(51) Int. Cl.
*A47G 5/02* (2006.01)

(52) U.S. Cl. ..... 160/238; 160/296; 160/299

(58) Field of Classification Search ..... 160/238, 160/299, 296; 242/381.2, 422.5
See application file for complete search history.

(56) References Cited

U.S. PATENT DOCUMENTS

| | | | | |
|---|---|---|---|---|
| 1,171,215 | A | 2/1916 | Lane | |
| 1,882,623 | A * | 10/1932 | Kasper | 160/299 |
| 1,911,232 | A | 5/1933 | Large | |
| 2,894,578 | A | 7/1959 | Caesar et al. | |
| 4,122,559 | A | 10/1978 | Kelly | |
| 4,344,473 | A | 8/1982 | Shore | |
| 4,597,430 | A | 7/1986 | Marquez | |
| 5,313,999 | A | 5/1994 | Colson et al. | |
| 5,445,209 | A | 8/1995 | Lichy | |
| 5,462,105 | A * | 10/1995 | Supernak | 160/323.1 |
| 5,482,104 | A | 1/1996 | Lichy | |
| 5,632,317 | A | 5/1997 | Krupke et al. | |
| 5,794,357 | A | 8/1998 | Gilliam et al. | |
| 6,059,007 | A | 5/2000 | Tomita | |
| 6,164,363 | A | 12/2000 | Colson et al. | |
| 6,299,115 | B1 * | 10/2001 | Kovach et al. | 248/262 |
| 6,434,797 | B1 | 8/2002 | Sagman | |
| 6,595,451 | B1 | 7/2003 | Kang et al. | |
| 6,712,115 | B2 | 3/2004 | Judkins | |
| 7,114,543 | B2 | 10/2006 | Heitel | |
| 7,147,029 | B2 | 12/2006 | Kovach et al. | |
| 7,222,811 | B2 | 5/2007 | Chang | |
| 7,240,715 | B2 | 7/2007 | Hoffmann | |
| 7,311,131 | B2 | 12/2007 | Nien et al. | |
| 7,500,505 | B2 | 3/2009 | Smith et al. | |
| 2001/0001414 | A1 | 5/2001 | Colson et al. | |
| 2006/0272783 | A1 | 12/2006 | Smith et al. | |

* cited by examiner

*Primary Examiner* — Blair M. Johnson

(74) *Attorney, Agent, or Firm* — Dorsey & Whitney LLP

(57) ABSTRACT

A device for correcting skew in roll-up retractable coverings for architectural openings includes a friction device positioned within the head rail for movement between releasably fixed positions and disposed for engagement with the fabric of the covering to regulate the rate at which the fabric is wrapped about a roller in the covering at selected locations along the length of the roller to correct for any inherent skew in the covering.

6 Claims, 10 Drawing Sheets

SKEW ADJUSTMENT DEVICE FOR COVERINGS FOR ARCHITECTURAL OPENINGS

CROSS REFERENCE TO RELATED APPLICATIONS

The present application is a division of co-pending U.S. patent application Ser. No. 11/750,041 ("the '041 application") filed on May 17, 2007 and entitled "Skew Adjustment Device For Coverings For Architectural Openings", which claims the benefit under 35 U.S.C. §119(e) to U.S. provisional patent application No. 60/747,957 ("the '957 application") filed on May 23, 2006 and entitled "Skew Adjustment Device For Coverings For Architectural Openings." The '041 and '957 applications are incorporated by reference into the present application in their entireties.

BACKGROUND OF THE INVENTION

1. Field of the Invention

The present invention relates generally to coverings for architectural openings and more particularly to a skew adjustment device positioned within the head rail of the covering to maintain a uniform rollup of covering fabric onto a roller disposed within the head rail.

2. Description of the Relevant Art

Coverings for architectural openings have assumed different forms over many years. Early forms of coverings simply consisted of fabric draped across all or some portion of an architectural opening such as a door, archway, window or the like.

Retractable coverings have also been a popular product wherein the covering is either suspended vertically and retracted to one or both sides of the architectural opening or rolled up or down about a roller at the top or bottom of the opening. The latter category of retractable coverings include a flexible fabric or fabric like material that is connected to a roller and can be retracted about the roller in a retracted condition of the covering or extended from the roller across the architectural opening in an extended condition.

One problem with retractable coverings that include a flexible material that is wound onto or unwound from a roller resides in the material skewing as it is wound onto the roller or unwound from the roller. When the material skews, it translates horizontally along the longitudinal axis of the roller as it is raised and wraps around the roller in a spiral fashion sometimes referred to as barber poling. As a result, the bottom rail along the bottom edge of the material is not desirably horizontally disposed during operation of the covering. Skewing of the material can be caused by various features of the covering including the roller not being horizontally mounted, the fabric not being fixed to the roller horizontally, or the fabric being asymmetrically configured, but regardless of the cause of the skew, it is aesthetically undesirable and can cause the fabric to engage the housing for the roller where it can fray. Accordingly, attempts have been made to correct skew.

Typically, the skew is corrected with a ballast bar or bars slidably positioned in the bottom rail of the covering so that the ballast bar or bars can be releasably fixed at any desired location along the horizontal length of the bottom rail. This of course shifts the center of gravity of the bottom rail which counters the bias in the covering material so that the bottom rail remains horizontal as desired for operation and aesthetics.

While ballast bars in the bottom rail are typically concealed within the bottom of the bottom rail, under certain circumstances, they can become visible and accordingly alternative anti-skew systems are continually being investigated.

It is to provide an alternative skew adjustment system that the present invention has been developed.

SUMMARY OF THE INVENTION

The skew adjustment system of the present invention is incorporated into the head rail of a rollup covering for architectural openings wherein the covering includes a flexible fabric or fabric-like material adapted to be wound about a roller in the head rail when retracting the covering or unwound from the roller when extending the covering. It has been found that by creating a point of increased tension on the flexible material at a predetermined fixed position along the horizontal length of the roller the tendency of the fabric to skew as it is being rolled on or unrolled from the roller can be offset.

In accordance with the present invention, an engagement arm is slidably positionable at releasably fixed positions along the horizontal length of the head rail, with the arm being resilient and adapted to slidably engage the fabric material when it is at least partially wound about the roller. The engagement arm creates a frictional drag on the material which inhibits the wrapping of the material at the location of the engagement arm while allowing other locations along the length of the roller to accept the fabric with a looser wrap so as to counter the skew bias. Other aspects, features and details of the present invention can be more completely understood by reference to the following detailed description of a preferred embodiment, taken in conjunction with the drawings and from the appended claims.

DESCRIPTION OF THE PREFERRED EMBODIMENT

Figure 1:
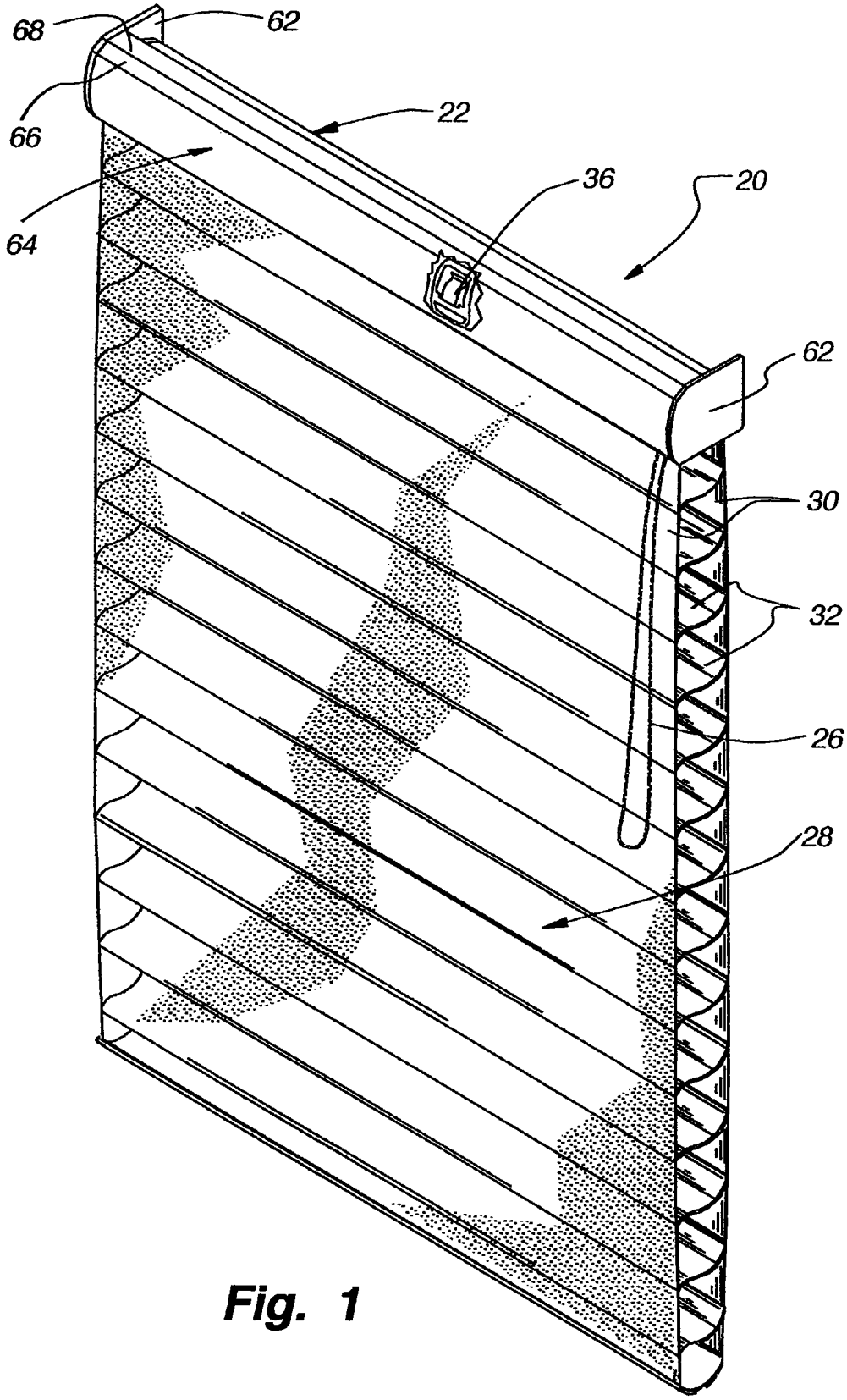
FIG. 1 is an isometric view of a retractable covering for an architectural opening shown in an extended position with a portion of the head rail removed to show the skew adjustment device of the present invention.

Referring first to FIG. 1, a covering 20 for an architectural opening such as a door, window, archway or the like is illustrated in a fully extended position. The covering can be seen to include a head rail 22 that rotatably supports a roller 24 (FIG. 5A) that is reversibly driven by a control cord 26 in a conventional manner. The roller supports a flexible fabric material 28 which for illustrative purposes is shown as being comprised of a pair of face sheets 30 of material such as sheer interconnected at vertically spaced locations by horizontally disposed translucent flexible vanes 32. Other fabric or fabric-like materials could be used in lieu of the material illustrated as will be appreciated with the description that follows. The bottom edge of the fabric material supports a rigid bottom rail 34. A fabric covering of the type illustrated is described in detail in applicant's U.S. Pat. No. 5,313,999, the disclosure of which is hereby incorporated by reference. As can also be seen in FIG. 1, at the location where the head rail is broken away, a skew adjustment device 36 in accordance with the present invention is incorporated into the head rail and the device and its operation will be described hereafter.

Figure 3:
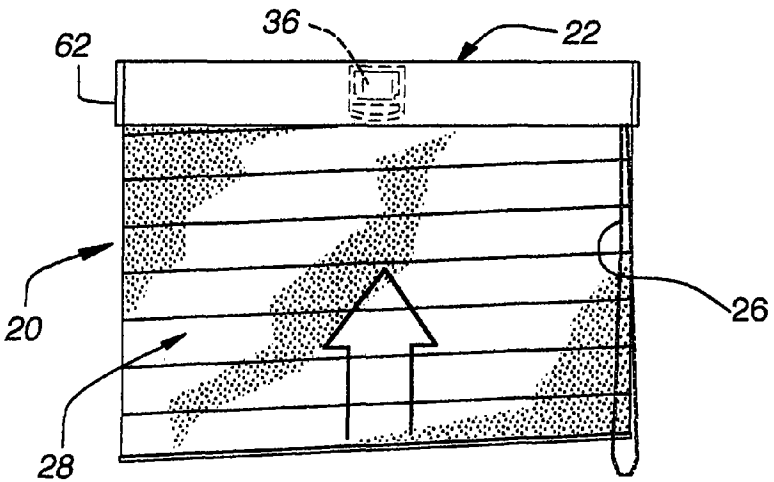
FIG. 3 is a front elevation similar to FIG. 2 showing the covering partially retracted and with the bottom rail inclined relative to horizontal illustrating a skew in the fabric of the covering.
Figure 4:
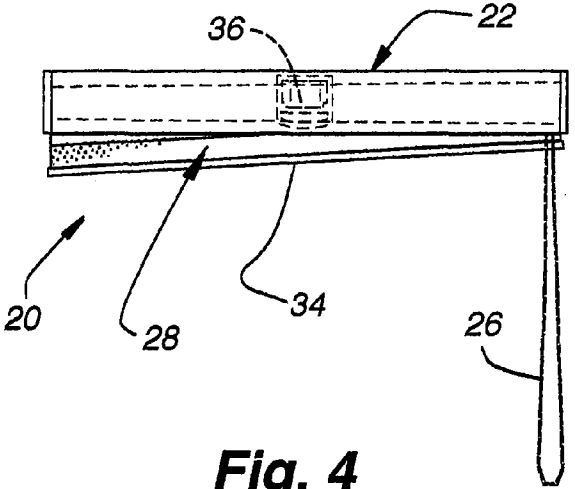
FIG. 4 is a front elevation similar to FIG. 3 with the covering fully retracted and with the bottom rail still forming an incline with horizontal.
Figure 2:
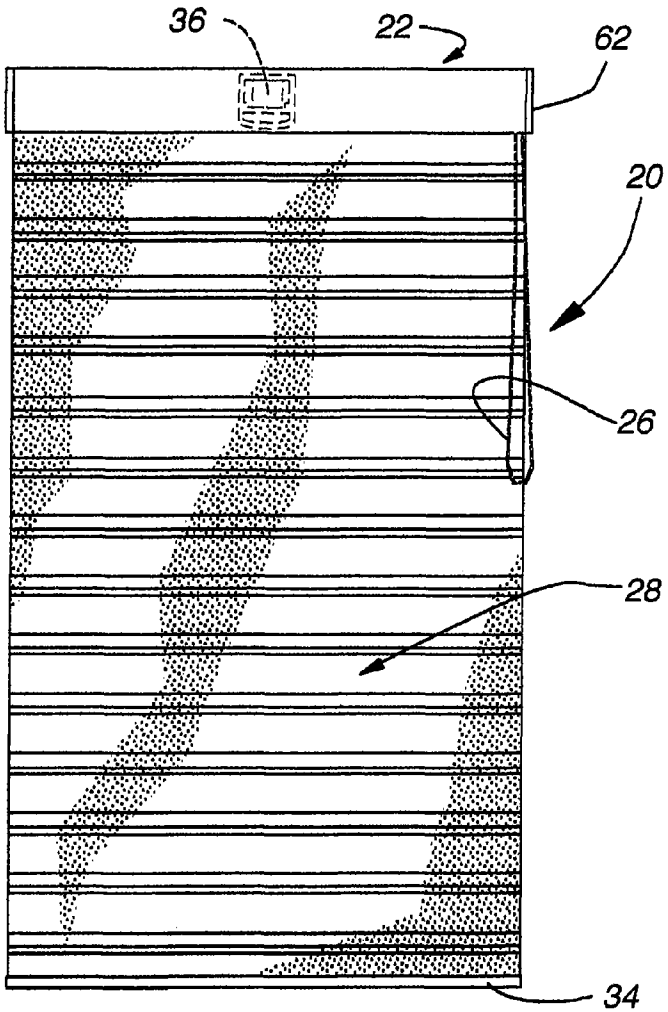
FIG. 2 is a front elevation of the covering of FIG. 1 with the skew adjustment device shown in dash lines.

The covering 20 shown in FIG. 1 is shown in a front elevation in FIG. 2. As will be appreciated, the bottom rail 34 is disposed horizontally and in a parallel relationship with the head rail 22 as is desired for aesthetics. In FIG. 3, however, the covering is shown partially retracted and it can be seen the bottom rail forms an acute angle with horizontal with this position of the covering being referred to in the industry as skewed. In other words, as the fabric material is being wrapped around the roller 24, the right edge is wrapping more rapidly or more tightly than the left edge causing the bottom rail to skew or tilt as illustrated. Of course, such a skew is undesirable from an aesthetic standpoint, and in fact, when the covering is fully retracted as shown in FIG. 4, the bottom rail is clearly no longer parallel with the head rail as it was when the covering was fully extended in FIG. 2. It should also be noted in FIGS. 2-4 that the skew adjustment device 36 which is shown in dashed lines, as it is hidden within the head rail, is longitudinally centered within the horizontal head rail.

As will be more clearly appreciated with the description that follows, the skew adjustment device 36 is slidably disposed within the head rail 22 and can be releasably fixed at any position along the horizontal length of the head rail. The skew adjustment device is a frictional device that slidably engages and compresses the fabric material 28 as it is being wrapped onto the roller or unwrapped from the roller 24. The frictional engagement with the fabric material provides drag and compression at a preselected position along the horizontal length of the roller so that the rate at which the fabric wraps about the roller at the location of engagement and the tightness of the wrap can be controlled thereby controlling skew.

Figure 6:
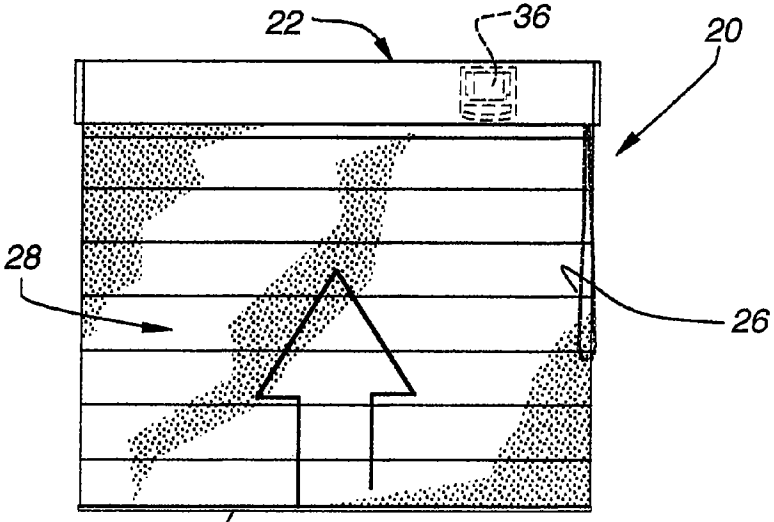
FIG. 6 is a front elevation similar to FIG. 5 showing the covering in a partially retracted position.
Figure 7:
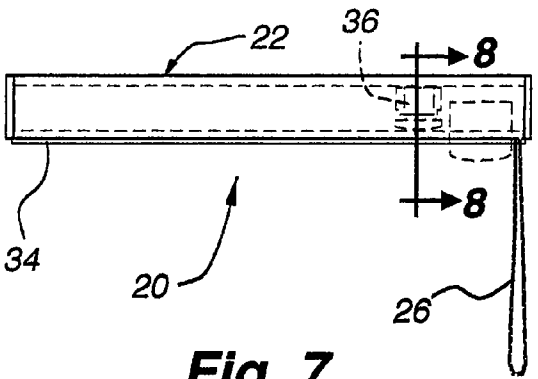
FIG. 7 is a front elevation similar to FIG. 6 with the covering fully retracted.
Figure 5:
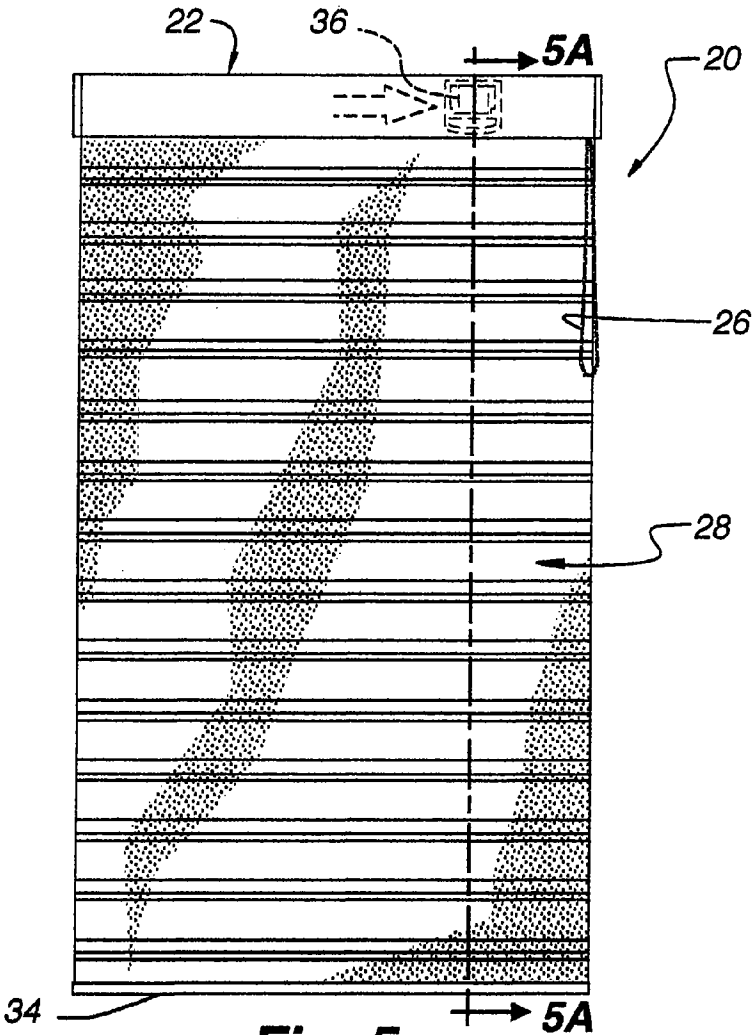
FIG. 5 is a front elevation similar to FIG. 2 with the covering in a fully extended position but with the skew adjustment device having been shifted to the right.
Figure 5A:
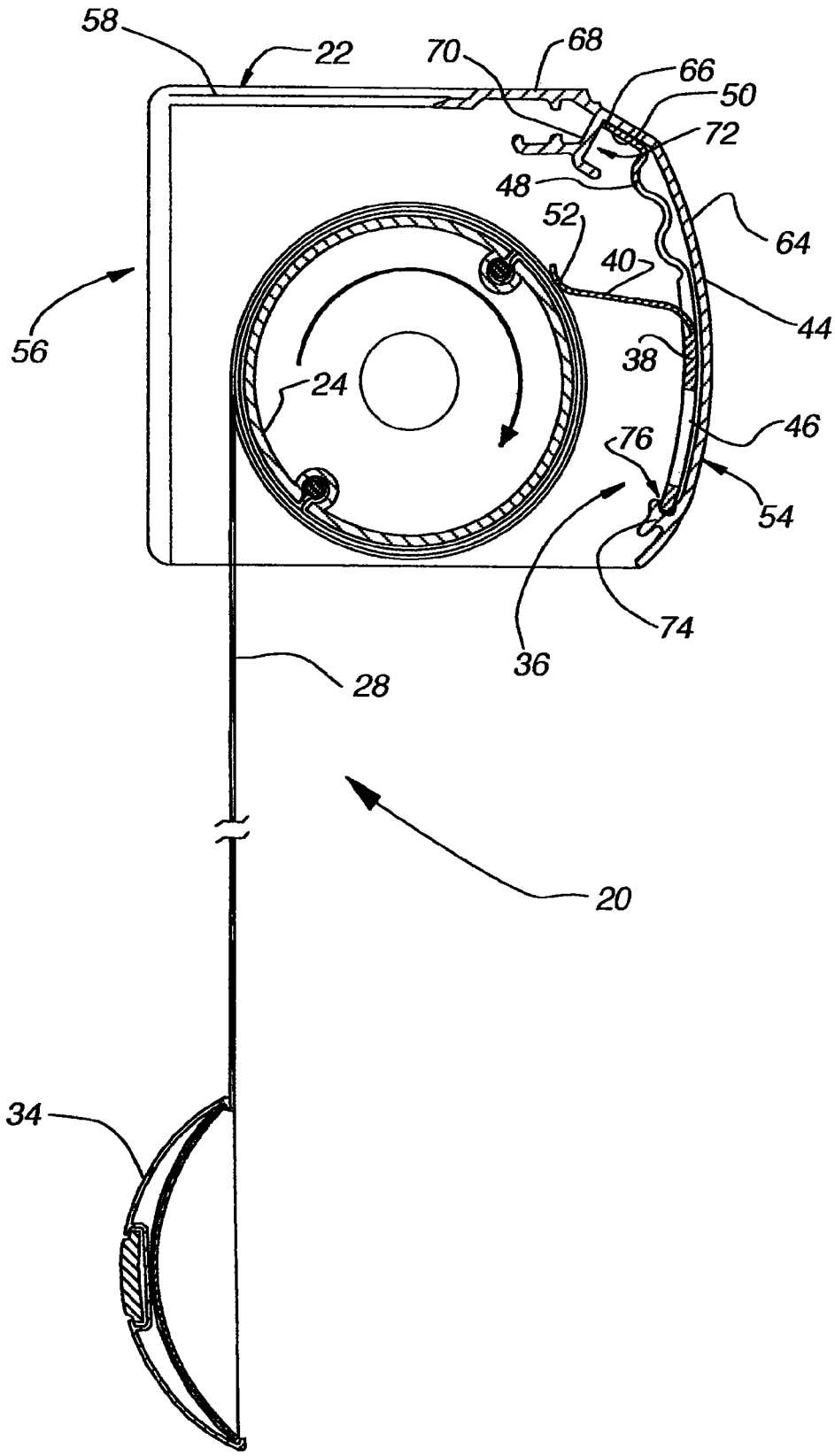
FIG. 5A is an enlarged fragmentary section taken along line 5A- 5A of FIG. 5.

With reference to FIGS. 5-7, FIG. 5 shows the covering 20 fully extended and of course the bottom rail 34 is horizontal and parallel with the head rail 22. The skew adjustment device 36 is positioned to the right of center so as to correct the skew illustrated in FIGS. 2-4. In FIG. 6, the covering has been partially retracted and due to the affect of the skew adjustment device on the fabric material 28 being wrapped about the roller, the bottom rail remains horizontal and parallel with the head rail as desired. FIG. 7 shows the covering fully retracted and as will be appreciated, the bottom rail is flush and parallel with the head rail as desired.

Figure 16:
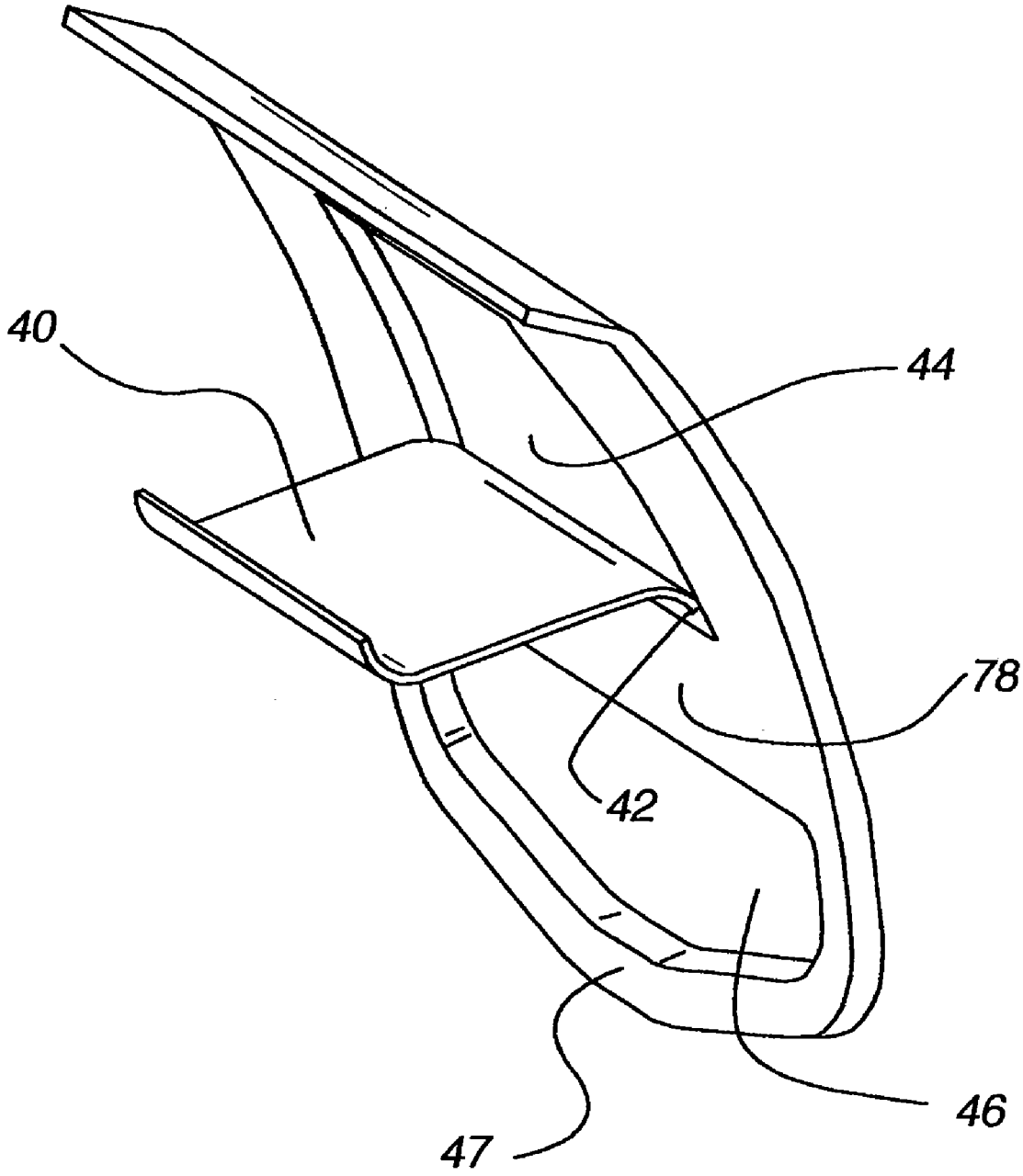
FIG. 16 is an isometric of a second embodiment of the skew adjustment device.

With reference to FIGS. 9-13, the skew adjustment device 36 can be seen to be a punched or molded member that is made of a semi-rigid but resilient material such as plastic, aluminum, spring steel or the like and includes an arched plate-like back 38 with an integral forwardly and upwardly inclined engagement arm 40. The bottom edge 42 of the engagement arm is integral with the bottom edge of an opening 44 through the plate-like back of the device and due to the integral connection of the engagement arm with the back along an edge of the engagement arm and the resilient semi-rigid characteristics of the material from which the device is made, the engagement arm is spring biased so that if deflected up or down, it will be encouraged or biased to return to the neutral position shown in FIG. 9. A second opening 46 is provided through the back plate 38 adjacent to the bottom edge thereof thereby defining a somewhat flexible arched segment 47. As is possibly best appreciated by reference to FIGS. 11 and 13, the plate-like back of the device is generally arcuate and concave in a forward direction having an optional horizontally wavy or serpentine segment 48 immediately above the location of attachment of the engagement arm 40 with the back 38. An illustration of the skew adjustment device without the serpentine segment 48 is shown in FIG. 16. A flat horizontal tab 50 is provided in the device above the serpentine segment for a purpose to be described hereafter.

It should also be noted that the free or distal edge 52 of the engagement arm is hook shaped so as to provide a smooth curved forwardly convex edge portion which as will become more clear hereafter, slidably engages the fabric material 28 in the covering to correct any skew that may be inherent therein.

Figure 8:
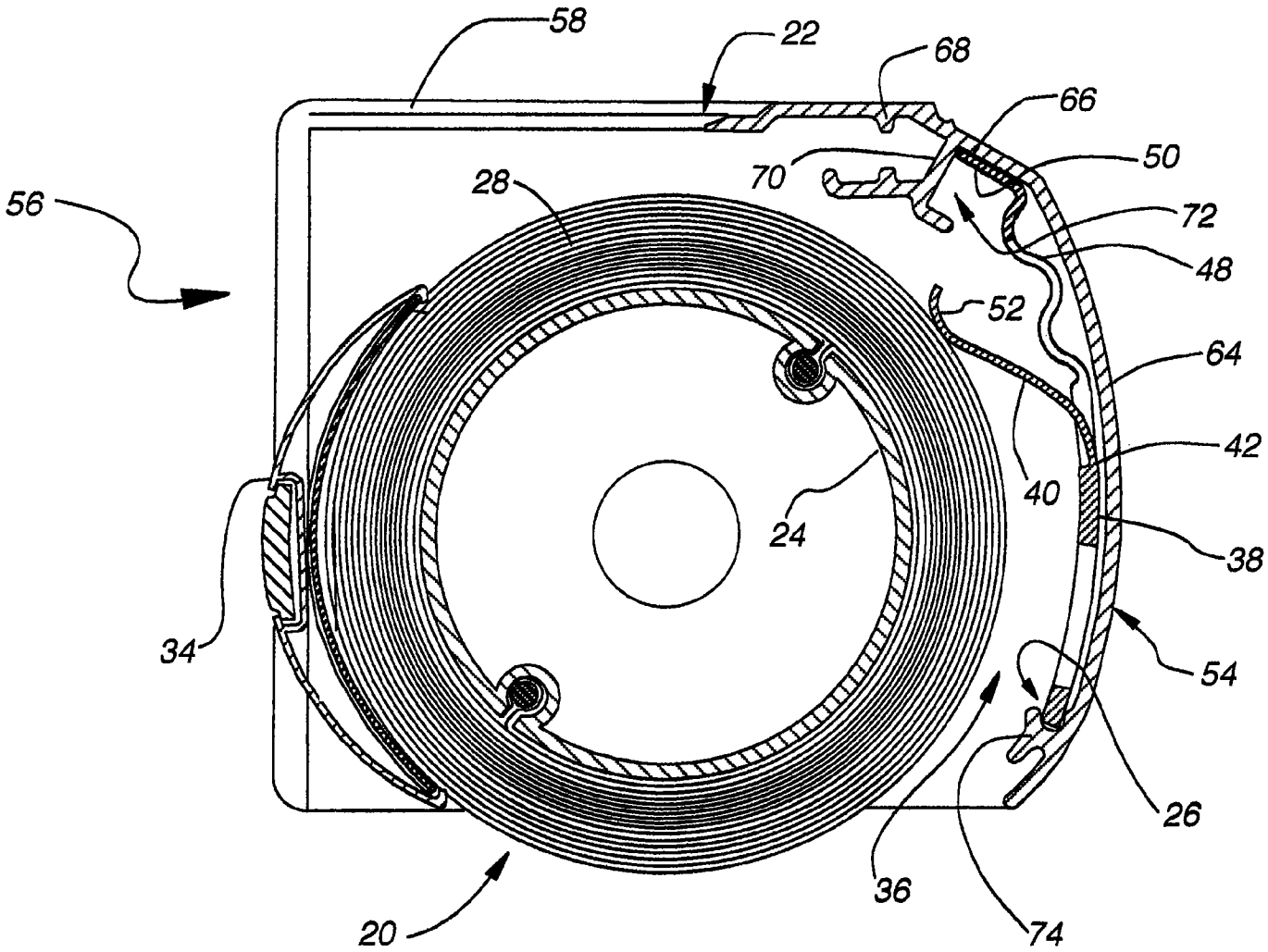
FIG. 8 is an enlarged vertical section taken along line 8-8 of FIG. 7.
Figure 10:
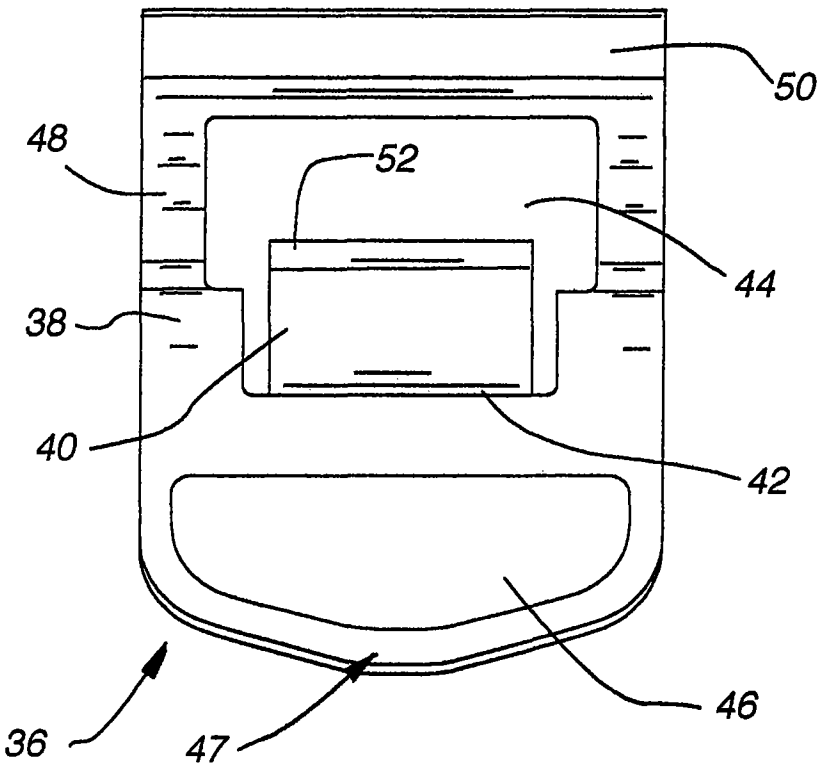
FIG. 10 is a view of the skew adjustment device taken along line 10-10 of FIG. 9.
Figure 9:
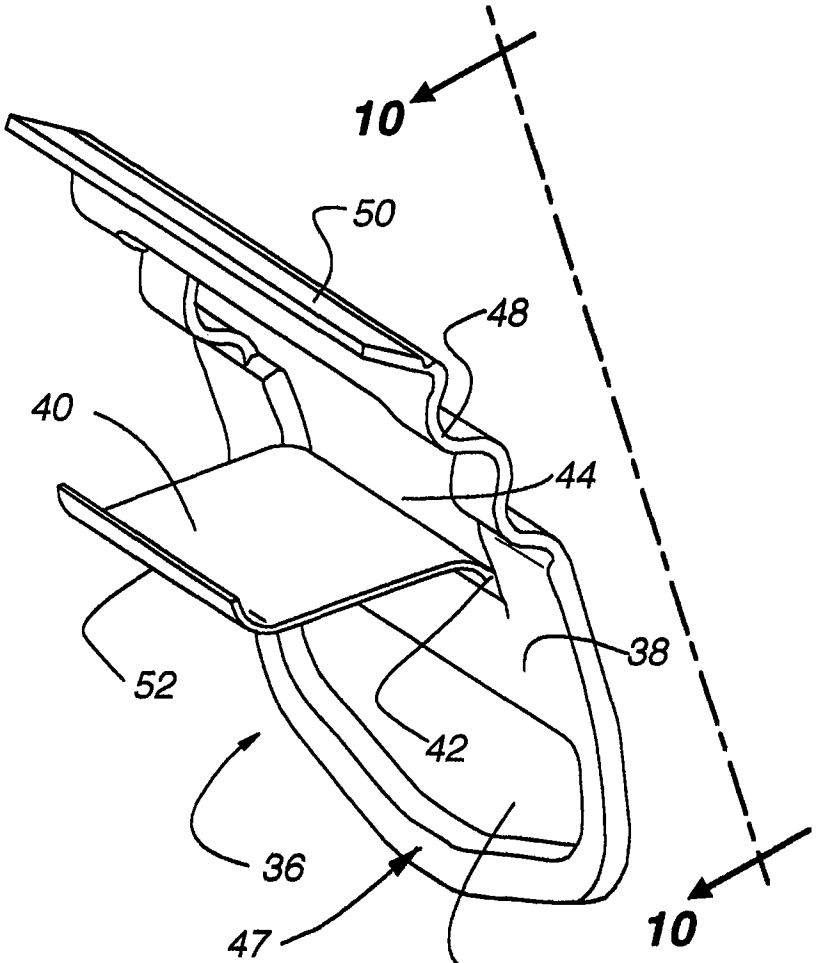
FIG. 9 is an isometric showing the skew adjustment device of the present invention.
Figures 11, 12, 13:
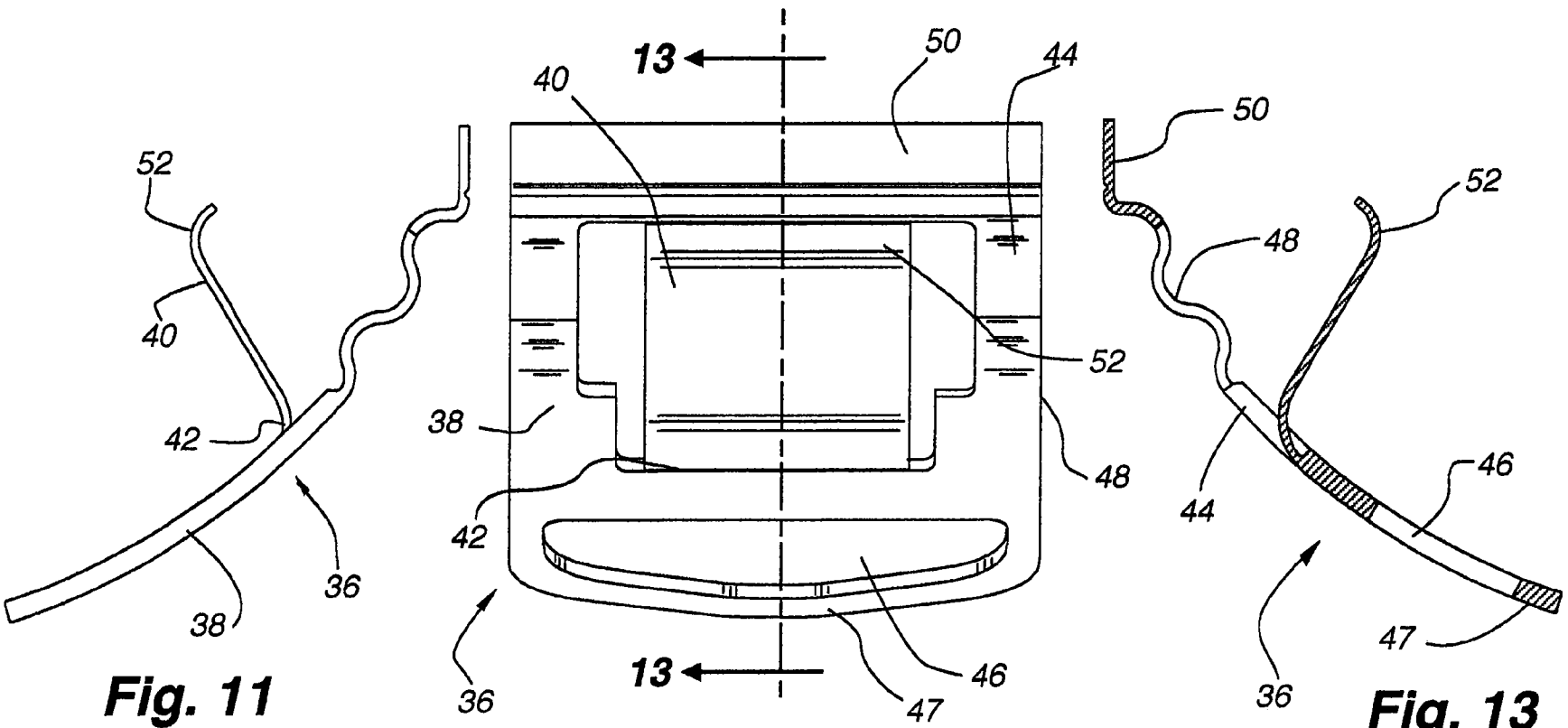
FIG. 11 is a left-side elevation of the skew adjustment device of FIG. 9.
FIG. 12 is a front elevation of the skew adjustment device.
FIG. 13 is a section taken along line 13-13 of FIG. 12.

The head rail 22 for the covering as possibly best seen in FIG. 8, includes an arcuate front wall 54 connected to a rear component 56 and a top wall 58. The space between the front wall and an open rear of the head rail along the bottom of the head rail is also open so the fabric for the covering can be rolled onto or unrolled from the roller 24 through the open bottom of the head rail. End caps 62 are also provided at opposite ends of the head rail for aesthetics.

The front wall 54 of the head rail 22, again as probably best seen in FIG. 8, has an arcuate main body 64 continuous upwardly with an inclined flat segment 66 that is in turn continuous with a generally flat upper ledge 68 that interconnects with the top wall 58 of the rear component 56 of the head rail in a conventional manner. Adjacent to the uppermost edge of the inclined flat segment 66 of the front wall, a generally inverted T-shaped rib 70 extends inwardly perpendicularly to the inclined flat segment and defines a downwardly opening pocket or groove 72 for receipt of the horizontal tab 50 along the upper edge of the skew adjustment device 36 as will be more clear hereafter. Adjacent to the lower edge of the arcuate main body 64 of the front wall of the head rail is another generally T-shaped inward projection 74 which defines an upperwardly opening seat or groove 76 for the lower edge of the skew adjustment device.

The front wall 54 of the head rail 22 is preferably an extruded member that can be made from aluminum, plastic or other suitable material so that the features described above are formed continuously along the horizontal length of the front wall. Accordingly, the pocket 72 and the seat 76 are confronting along the inner surface of the front wall for slidable receipt of the top and bottom edges of the skew adjustment device.

Figure 15:
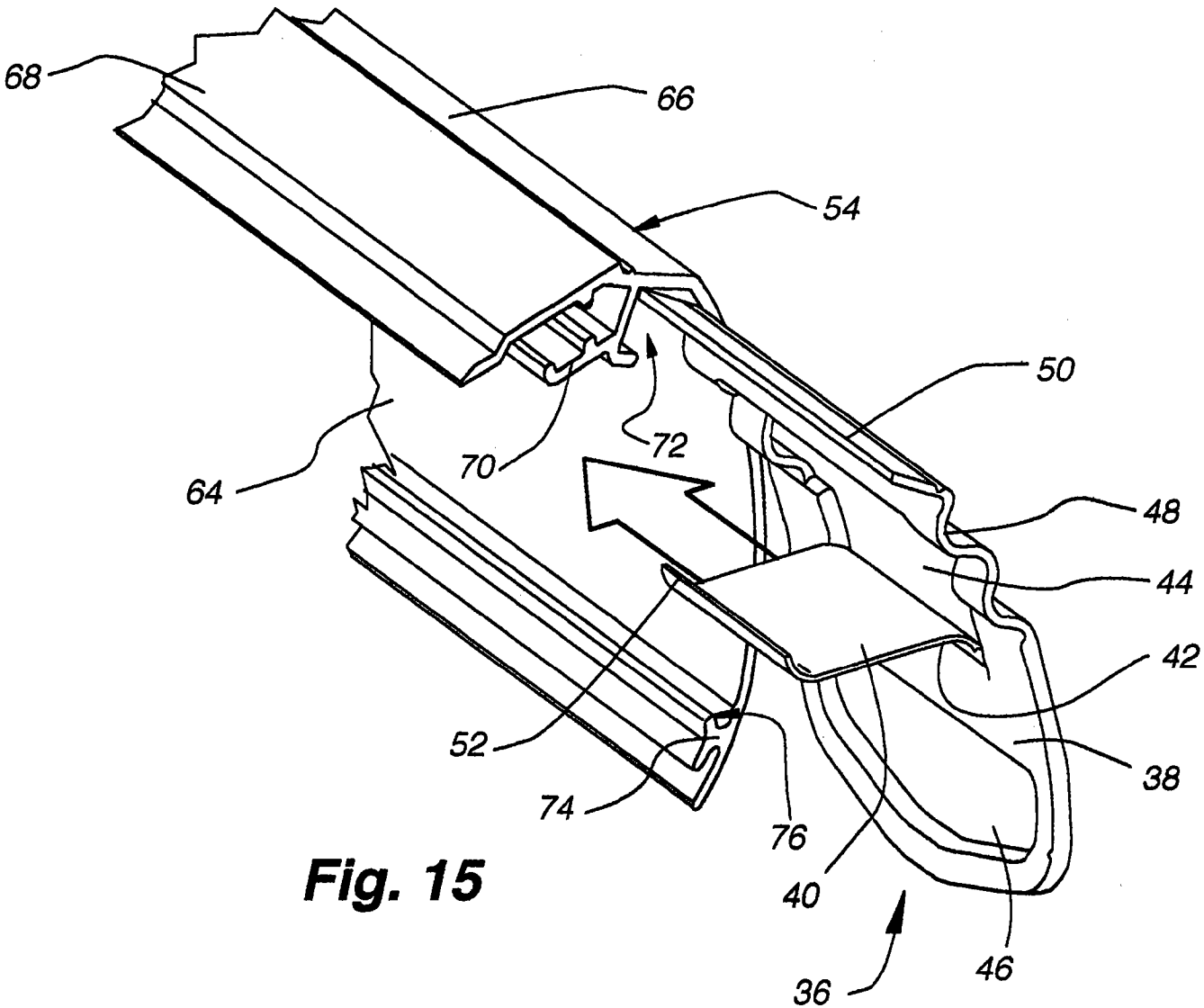
FIG. 15 is a fragmentary isometric showing the skew adjustment device being inserted into the head rail.

With reference to FIG. 15, the skew adjustment device 36 can be seen being inserted into the space on the front wall 54 between the pocket 72 and the seat 76 by positioning the flat horizontal tab 50 along the top edge of the skew adjustment device into the pocket at the top of the front wall of the head rail and then sliding the skew adjustment device along the inner surface of the front wall of the head rail until the bottom edge of the skew adjustment device is received in the upwardly opening seat 76. The skew adjustment device, as mentioned, is made of a semi-rigid but resilient material and is sized so that it is compressed into the space between the upperwardly opening seat and the downwardly opening pocket with some spring bias being provided by the serpentine segment 48 of the skew adjustment device along with the inherent resilient characteristics of the material from which the skew adjustment device is made. Due to the flexibility of the device, it can also be inserted into the head rail laterally and snapped into place at a desired location.

Figure 14:
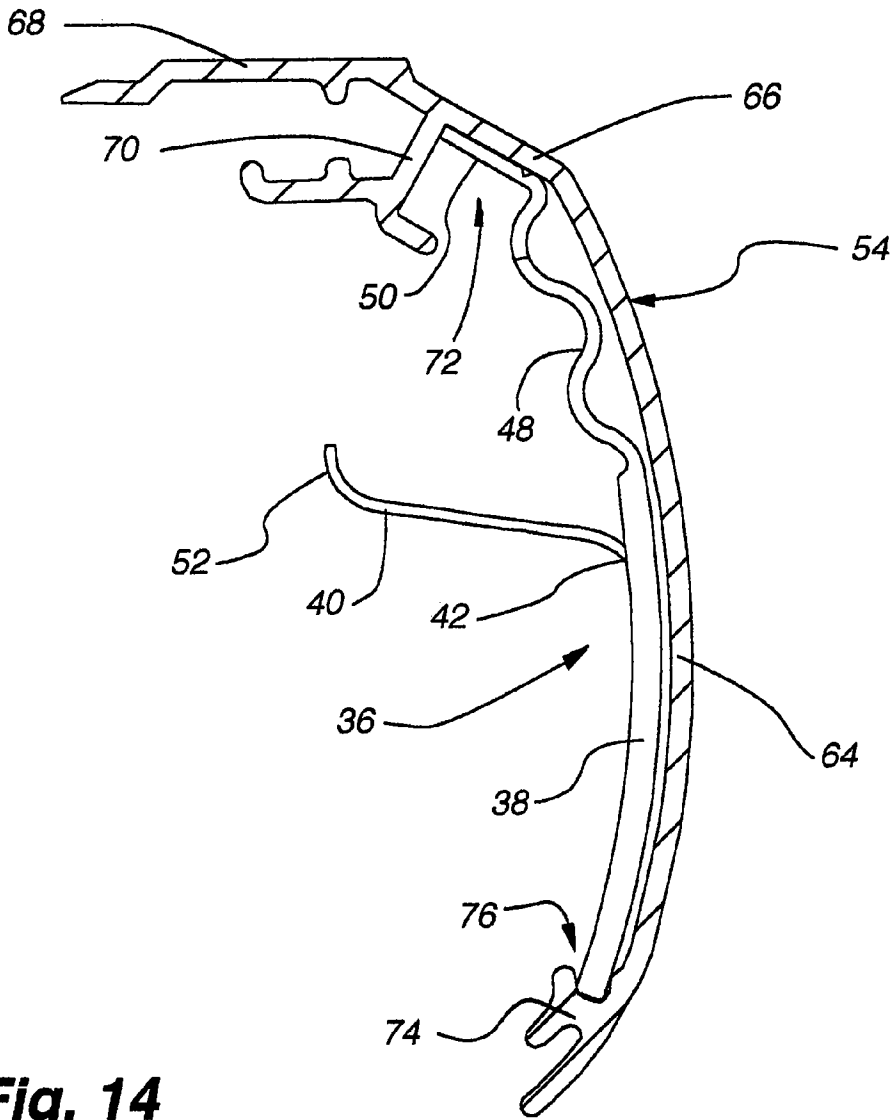
FIG. 14 is an enlarged vertical section taken through a portion of the head rail of the covering of FIG. 1 with the skew adjustment device positioned in the head rail.

When the skew adjustment device 36 is fully and slidably mounted on the front wall 54 of the head rail 22, it is positioned as seen best in FIG. 14 so as to apply pressure along the top and bottom edges against the pocket 72 and the seat 76 so that it can be releasably frictionally fixed at any position along the length of the head rail. As will be appreciated in FIGS. 5A and 8, when the skew adjustment device is desirably and slidably mounted on the head rail, the engagement arm 40 projects inwardly toward the roller 24.

The hook shaped distal edge 52 of the engagement arm 40 as mentioned above provides a smooth curved convex surface for engagement with the material or fabric 28 of the covering and due to the arcuate nature of the distal edge of the engagement arm, the arm engages the material of the covering tangentially so as not to snag the material. As will be appreciated in FIGS. 5A and 8, when the material is substantially unwrapped from the roller 24, the engagement arm remains in frictional engagement with the material as it obviously does when the material is fully wrapped about the roller as shown in FIG. 8.

The engagement of the arm 40 with the material 28 is designed to establish a frictional drag on the material and compresses the material on the roller as it is being wrapped or unwrapped from the roller. As will be appreciated by providing frictional drag and compression at a predetermined location along the length of the roller 24 the fabric is encouraged to wrap or unwrap in an unnatural way. This of course is designed to counter or offset the natural bias that may be in the fabric causing it to skew if not corrected. In other word, at the location on the fabric where the skew adjustment device 36 is engaged, the fabric is compressed toward the roller causing the material beneath the engagement arm to wrap more slowly and more tightly about the roller or unwrap more slowly and more tightly from the roller. Due to the fact that the skew adjustment device can be releasably fixed through friction at any position along the length of the head rail 22, any degree of skew or inherent bias in the covering can be corrected.

By way of example, if the skew in the covering is as illustrated in FIG. 3 with the right edge of the fabric 28 being wrapped more rapidly and more loosely than the left edge, the skew adjustment device 36 can be shifted to the right as shown in FIGS. 5-7 to provide a frictional drag and increased tension toward the right side of the fabric allowing the left side to catch up so that the covering can be extended and retracted without skew.

An alternative embodiment of the skew adjustment device is shown in FIG. 16 where again the device is made of a semi-rigid but resilient material wherein an arched plate-like back 78 of the device is smooth and does not include the serpentine segment 48 of the first-described embodiment. The device again includes an integral forwardly and upwardly inclined engagement arm 40 with the bottom edge 42 of the engagement arm being integral with the bottom edge of an opening 44 through the plate-like back 78 of the device and due to the integral connection of the engagement arm with the back along an edge of the engagement arm and the resilient semi-rigid characteristics of the material from which the device is made, the engagement arm is spring biased so if deflected up or down, it will be encouraged or biased to return to the neutral position shown in FIG. 16. Again, an opening 46 is provided through the back plate adjacent to the bottom edge thereof which defines a somewhat flexible arched segment 47 as in the first-described embodiment. The resiliency of the material and the relatively thin arched segment 47 in comparison to the remainder of the back plate enables the device to be laterally inserted and snapped into place within the head rail. It will be appreciated the serpentine segment 48 of the first-described embodiment is an optional feature of the device and is not mandatory.

Although the present invention has been described with a certain degree of particularity, it is understood the disclosure has been made by way of example and changes in detail or structure may be made without departing from the spirit of the invention as defined in the appended claims.

The invention claimed is:

1. A method of maintaining a horizontal orientation of the bottom rail of a covering for an architectural opening, said covering including a headrail, an elongated roller in said headrail, a flexible shade material connected along a top edge to said roller and along a bottom edge to said bottom rail, and a control system for reversibly rotating said roller to wrap and unwrap said shade material about said roller, comprising the step of compressing said shade material at a preselected location along the length of said roller with a one-piece engaging member to effect a substantially uniform tightness in the wrap of said material along the length of said roller.

2. The method of claim 1 wherein the engaging member includes a resilient arm mounted within said headrail.

3. The method of claim 2 wherein said engaging member is slidably movable along the length of said headrail between releasably fixed positions.

4. The method of claim 3 wherein said resilient arm is attached to a substantially planar base having top and bottom edges, and wherein said headrail includes opposed longitudinal grooves slidably receiving said top and bottom edges of said substantially planar base.

5. A method of maintaining a horizontal orientation of the bottom rail of a covering for an architectural opening, said covering including a headrail, an elongated roller in said headrail, a flexible shade material connected along a top edge to said roller and along a bottom edge to said bottom rail, and a control system for reversibly rotating said roller to wrap and unwrap said shade material about said roller, comprising the step of compressing said shade material at a preselected location along the length of said roller to effect a substantially uniform tightness in the wrap of said material along the length of said roller, wherein the compressing of the shade material is obtained with a resilient arm mounted within said headrail, and wherein said resilient arm is slidably movable along the length of said headrail between releasably fixed positions.

6. The method of claim 5 wherein said resilient arm is attached to a substantially planar base having top and bottom edges, and wherein said headrail includes opposed longitudinal grooves slidably receiving said top and bottom edges of said substantially planar base.

* * * * *